US011639676B2

(12) United States Patent
Golin et al.

(10) Patent No.: US 11,639,676 B2
(45) Date of Patent: May 2, 2023

(54) VEHICLE EXHAUST SYSTEM

(71) Applicant: Tenneco Automotive Operating Company Inc., Lake Forest, IL (US)

(72) Inventors: Michael A Golin, Ann Arbor, MI (US); Bradley Walworth, Ann Arbor, MI (US); Gabriel Ostromecki, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 892 days.

(21) Appl. No.: 16/443,282

(22) Filed: Jun. 17, 2019

(65) Prior Publication Data

US 2020/0392880 A1 Dec. 17, 2020

(51) Int. Cl.

| | |
|---|---|
| ***F01N 1/02*** | (2006.01) |
| ***F01N 13/00*** | (2010.01) |
| ***F01N 13/08*** | (2010.01) |
| ***F01N 1/00*** | (2006.01) |

(52) U.S. Cl.

CPC ..... *F01N 1/026* (2013.01); *F01N 13/007* (2013.01); *F01N 13/08* (2013.01); *F01N 1/006* (2013.01)

(58) Field of Classification Search

CPC ..... F01N 1/003; F01N 1/006; F01N 1/026; F01N 13/007; F01N 13/04; F01N 13/08; F01N 2410/10; F01N 2410/14; F02M 35/1238; F02M 35/10144; F02M 35/1216

See application file for complete search history.

(56) References Cited

U.S. PATENT DOCUMENTS

| | | | | |
|---|---|---|---|---|
| 1,989,675 | A * | 2/1935 | Bobo | F01N 1/08 181/254 |
| 4,842,096 | A * | 6/1989 | Fujitsubo | F01N 1/24 181/254 |
| 6,109,387 | A | 8/2000 | Boretti | |
| 7,802,651 | B2 * | 9/2010 | Park | F02M 35/14 55/502 |
| 8,162,103 | B2 * | 4/2012 | Barrieu | F01N 1/02 181/269 |
| 8,439,156 | B1 | 5/2013 | Abram | |
| 8,443,933 | B2 | 5/2013 | Pfeffer et al. | |

(Continued)

FOREIGN PATENT DOCUMENTS

| | | |
|---|---|---|
| CN | 108331638 | 7/2018 |
| EP | 1022505 | 7/2000 |

(Continued)

*Primary Examiner* — Jeremy A Luks
(74) *Attorney, Agent, or Firm* — McGarry Bair PC

(57) ABSTRACT

A vehicle exhaust system includes a tubular component having an inner surface and an outer surface. The vehicle exhaust system also includes at least one opening defined by the tubular component. The at least one opening extends through each of the inner surface and the outer surface. The vehicle exhaust system further includes a patch adapted to cover the at least one opening. The patch includes a first portion extending parallel to the central axis. The first portion defines a plurality of pores. The first portion covers the at least one opening. The patch also includes a second portion extending away from the first portion. The first portion has a first thickness and the second portion has a second thickness.

27 Claims, 8 Drawing Sheets

(56) References Cited

U.S. PATENT DOCUMENTS

| | | | | |
|---|---|---|---|---|
| 8,528,692 | B2 * | 9/2013 | Teshima | F02M 35/1216 123/184.55 |
| 9,605,631 | B2 * | 3/2017 | Zirkelbach | F02M 35/1216 |
| 9,970,340 | B2 | 5/2018 | Abram et al. | |
| 10,047,650 | B2 | 8/2018 | Abram | |
| 10,233,814 | B2 * | 3/2019 | Wasif | F01N 13/1872 |
| 11,225,897 | B2 * | 1/2022 | Baumgartner | F01N 1/02 |
| 2017/0089238 | A1 | 3/2017 | Leyko et al. | |

FOREIGN PATENT DOCUMENTS

| | | | | |
|---|---|---|---|---|
| FR | 2914958 | A1 * | 10/2008 | F02M 35/10144 |
| FR | 3027995 | A1 * | 5/2016 | F01N 1/006 |
| JP | H0626322 | | 2/1994 | |
| JP | 2001280114 | | 10/2001 | |
| JP | 2015129479 | A * | 7/2015 | F01N 1/006 |

* cited by examiner

VEHICLE EXHAUST SYSTEM

TECHNICAL FIELD

The present disclosure relates to a vehicle exhaust system. More particularly, the present disclosure relates to damping of sound generated by the vehicle exhaust system.

BACKGROUND

A vehicle exhaust system directs exhaust gas generated by an internal combustion engine to external environment. The exhaust system may include various components, such as pipes, converters, catalysts, filters, and the like. During operation of the exhaust system, as a result of resonating frequencies, the components may generate undesirable noise. Different methods have been employed in various applications to address this issue.

For example, the components, such as mufflers, resonators, valves, and the like, have been incorporated into the exhaust system to attenuate certain resonance frequencies generated by the exhaust system. However, such additional components are expensive and increase weight of the exhaust system. Also, adding new components into the exhaust system introduce new sources of undesirable noise generation.

A well-known sound attenuating method is a Standing Wave Management (SWM) technology. The SWM includes an opening provided on an exhaust pipe. The opening provides a secondary exhaust leak path for sound to exit the exhaust pipe and minimizes leakage of the exhaust gas through the opening. The SWM utilizes a series of holes to allow sound waves to exit the exhaust pipe while limiting leakage of the exhaust gas. In some instances, the holes may be covered with a microperforated material to dampen the noise. In order to achieve a desired noise attenuation, the holes have to be relatively large in size.

However, the microperforated material is very thin and is not as structurally sound as a solid pipe wall of the exhaust pipe. As such, creating holes in the microperforated material may adversely affect durability of the microperforated material. Additionally, if relatively larger holes are cut into the exhaust pipe and covered with the microperforated material, durability of the exhaust pipe may also be adversely affected. Another concern is with grazing flow that may occur across a surface of the microperforated material. The acoustic properties of the microperforated material may change when the exhaust gas flows across the surface of the microperforated material. This may often reduce an ability of an acoustic wave to propagate through the micro perforations, which may limit the damping effect.

Additionally, the SWM has a well-known failure mode when debris, such as salt or mud, may plug the opening. The SWM may include multilayer parts where the debris may accumulate behind the multilayer parts and result in premature failure of the SWM. Also, for efficient functioning of the SWM, a desired diameter size of each of the series of holes may have to be less than 1 millimeter (mm). However, conventional manufacturing methods make it difficult to produce a 1 mm diameter hole in a material thicker than 1 mm. More specifically, durability of the component may be compromised if component thickness may be limited to 1 mm. Hence, there is a need for an improved vehicle exhaust system for such applications.

In an example, a U.S. Patent describes a vehicle exhaust system including an exhaust component having an outer surface and an inner surface that defines an internal exhaust component cavity. At least one hole is formed in the exhaust component to extend through a wall of the exhaust component from the outer surface to the inner surface. A member is formed from a resistive material and is configured to overlap the at least one hole. At least one spacer is configured to space the member away from the inner or outer surface of the exhaust component to create an open cavity between the member and the exhaust component. In one example, an actuator is configured to cover and uncover the member dependent upon an operating characteristic to vary damping.

In another example, a U.S. Patent describes a device for preventing shock excitation of an acoustic enclosure. The device includes a pressure anti-nodal point comprising a mechanical oscillator. The mechanical oscillator is exposed to the acoustic enclosure at the anti-nodal point. The mechanical oscillator is also tuned to resonate at a frequency for which the anti-nodal point is the pressure anti-node.

Given description covers one or more above mentioned problems and discloses a method and a system to solve the problems.

SUMMARY

In an aspect of the present disclosure, a vehicle exhaust system is provided. The vehicle exhaust system includes a tubular component having an inner surface and an outer surface. The inner surface defines a primary exhaust gas flow path. The tubular component defines a central axis extending between an inlet end and an outlet end of the tubular component. The vehicle exhaust system also includes at least one opening defined by the tubular component. The at least one opening provides a secondary exhaust gas flow path. The at least one opening extends through each of the inner surface and the outer surface. The vehicle exhaust system further includes a patch adapted to cover the at least one opening. The patch includes a first portion extending parallel to the central axis. The first portion defines a plurality of pores. The first portion covers the at least one opening. The patch also includes a second portion extending away from the first portion. The first portion has a first thickness and the second portion has a second thickness.

In another aspect of the present disclosure, a tubular component for a vehicle exhaust system is provided. The tubular component includes an inner surface and an outer surface. The inner surface defines a primary exhaust gas flow path. The tubular component defines a central axis extending between an inlet end and an outlet end of the tubular component. The tubular component also includes at least one opening. The at least one opening provides a secondary exhaust gas flow path. The at least one opening extends through each of the inner surface and the outer surface. The tubular component further includes a patch adapted to cover the at least one opening. The patch includes a first portion extending parallel to the central axis. The first portion defines a plurality of pores. The first portion covers the at least one opening. The patch also includes a second portion extending away from the first portion. The first portion and the second portion together form an integral structure. The first portion has a first thickness and the second portion has a second thickness. The patch also includes at least one wire mesh insert. The at least one wire mesh insert is coupled with the first portion to cover at least one of the plurality of pores. The at least one wire mesh insert further includes an integrated retention system for coupling with the first portion of the patch.

In yet another aspect of the present disclosure, a patch adapted to cover at least one opening in a tubular component of a vehicle exhaust system is provided. The patch includes a plurality of pores. The patch also includes at least one wire mesh insert. The at least one wire mesh insert is coupled with the patch to cover at least one of the plurality of pores. The at least one wire mesh insert includes a first head portion, a second head portion, and an intermediate portion. The intermediate portion extends between each of the first head portion and the second head portion. Each of the first head portion and the second head portion is adapted to couple the at least one wire mesh insert with the patch. The intermediate portion is adapted to be disposed in at least one of the plurality of pores.

Other features and aspects of this disclosure will be apparent from the following description and the accompanying drawings.

DETAILED DESCRIPTION

Figure 1:
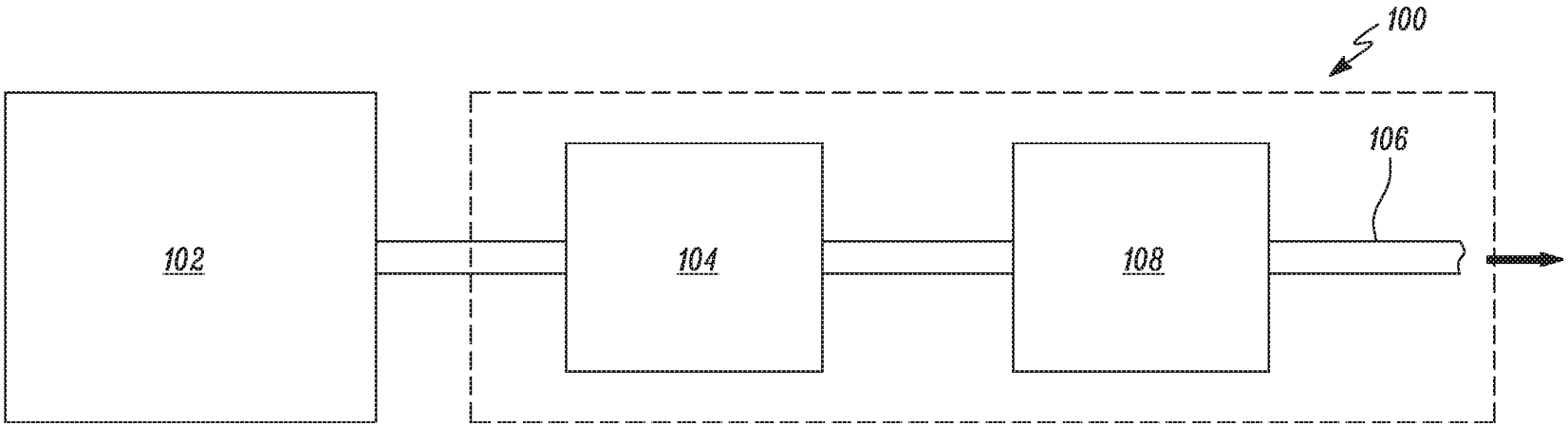
FIG. 1 is a schematic representation of a vehicle exhaust system, according to an aspect of the present disclosure.

Wherever possible, the same reference numbers will be used throughout the drawings to refer to same or like parts. Referring to FIG. 1, a schematic representation of a vehicle exhaust system 100 is illustrated. The vehicle exhaust system 100 will be hereinafter interchangeably referred to as the "system 100". The system 100 is fluidly coupled to an engine 102. The engine 102 may be any internal combustion engine powered by a fuel, such as diesel, gasoline, natural gas, and/or a combination thereof. Accordingly, the system 100 receives exhaust gas generated by the engine 102.

The system 100 includes a number of downstream exhaust components 104 fluidly coupled to the engine 102. The exhaust components 104 may include a number of systems/components (not shown), such as a Diesel Oxidation Catalyst (DOC), a Diesel Exhaust Fluid (DEF) unit, a Selective Catalytic Reduction (SCR) unit, a particulate filter, an exhaust pipe, and the like. The exhaust components 104 may be mounted in various different configurations and combinations based on application requirements and/or available packaging space. The exhaust components 104 are adapted to receive the exhaust gas from the engine 102 and direct the exhaust gas to the external atmosphere via a tailpipe 106. The exhaust components 104 are adapted to reduce emissions and control noise.

The system 100 also includes an acoustic damping member, such as a muffler 108. The muffler 108 is provided in fluid communication with the exhaust components 104 and the tailpipe 106. In the illustrated embodiment, the muffler 108 is disposed downstream of the exhaust components 104 and upstream of the tailpipe 106. In other embodiments, the muffler 108 may be disposed in any sequence with respect to each of the exhaust components 104 and/or the tailpipe 106, based on application requirements. The muffler 108 is adapted to dampen resonance frequencies generated during operation of the engine 102 and the system 100.

Figure 2:
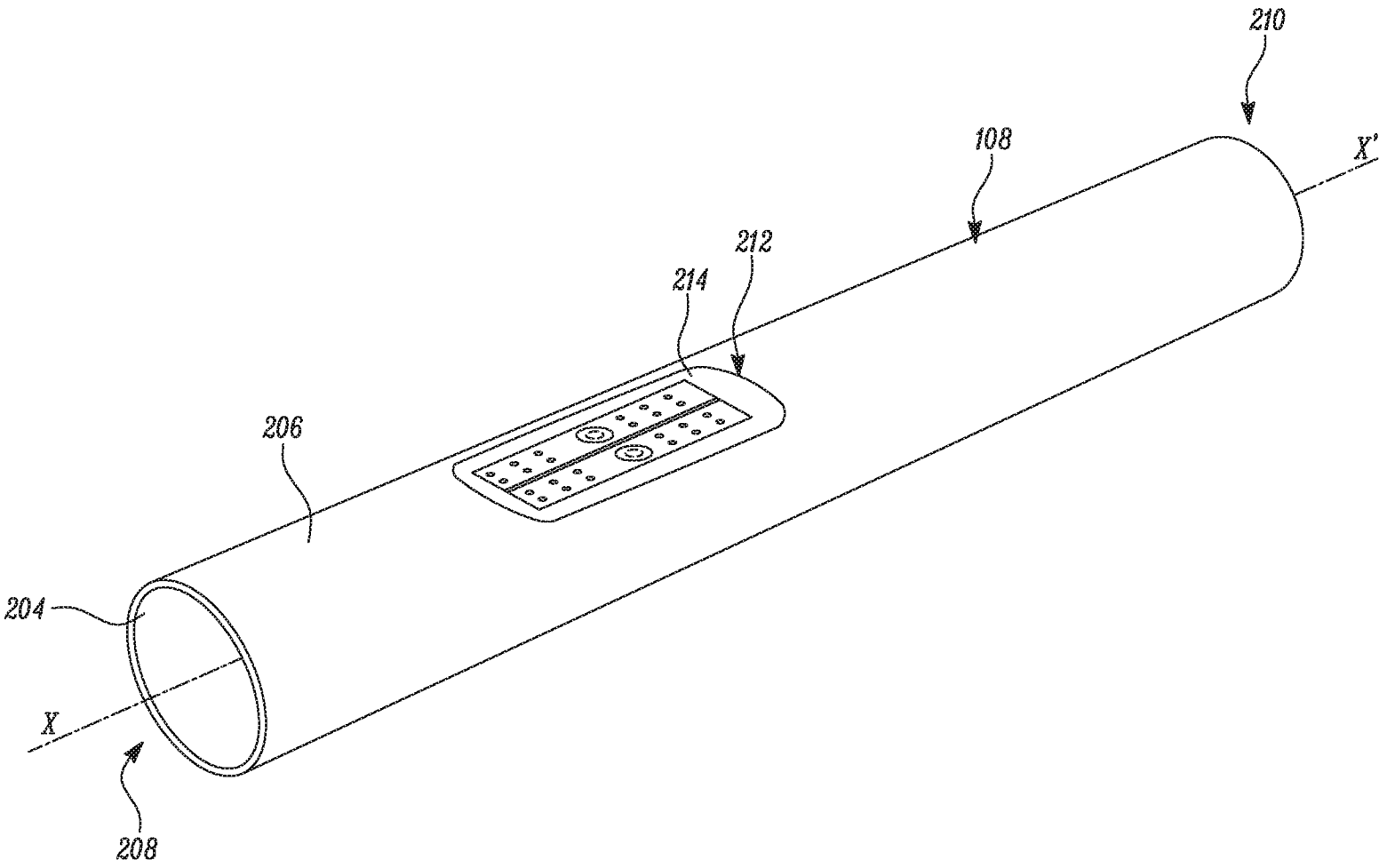
FIG. 2 is a perspective view of a tubular component of the vehicle exhaust system of FIG. 1, according to an aspect of the present disclosure.

Referring to FIG. 2, a perspective view of an exemplary tubular component 202 associated with the system 100 is illustrated. The tubular component 202 may be any one or more of the exhaust components 104 and/or any portion of the system 100, such as the exhaust pipe, the tailpipe 106, the muffler 108, and the like. The tubular component 202 has a substantially hollow and cylindrical configuration defining a central axis X-X'. Accordingly, the tubular component 202 includes an inner surface 204 and an outer surface 206. The tubular component 202 also includes an inlet end 208 and an outlet end 210. The outlet end 210 is disposed opposite and spaced apart with respect to the inlet end 208 along the central axis X-X'. The tubular component 202 defines a primary exhaust gas flow path along the inner surface 204 between the inlet end 208 and the outlet end 210 along the central axis X-X'.

The tubular component 202 also includes an opening 212. In the illustrated embodiment, the tubular component 202 includes a single opening 212. In other embodiments, the tubular component 202 may include multiple openings, based on application requirements. The opening 212 extends through each of the inner surface 204 and the outer surface 206. In the illustrated embodiment, the opening 212 has a substantially rectangular configuration. In other embodiments, the opening 212 may have any other configuration, such as circular, triangular, elliptical, and the like. The opening 212 provides a secondary exhaust gas flow path in association with the primary exhaust gas flow path.

Figure 3A:
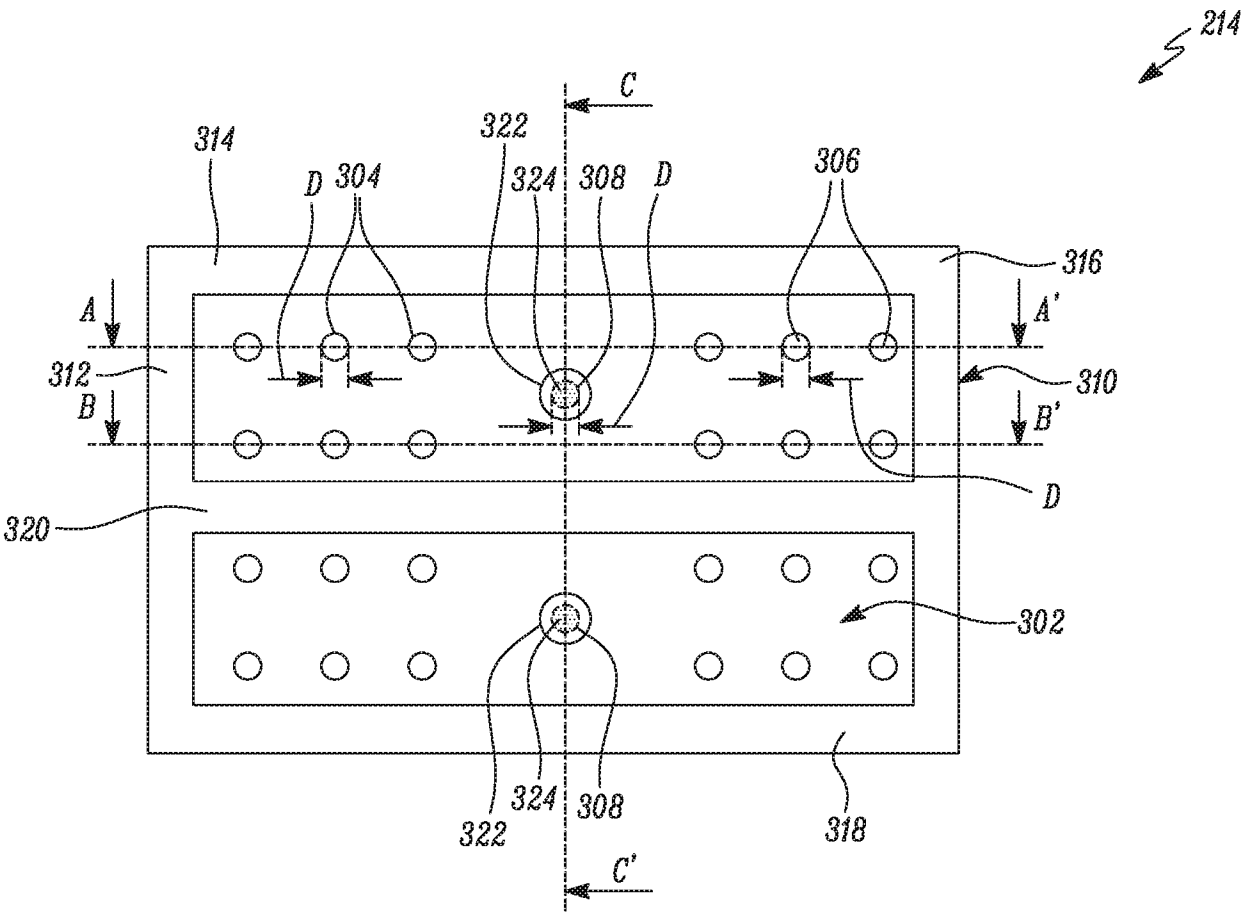
FIG. 3A is a front view of a patch for the tubular component of FIG. 2, according to an aspect of the present disclosure.

The system 100 also includes a patch 214 coupled to the tubular component 202. More specifically, the patch 214 is disposed adjacent to the opening 212 in order to cover the opening 212. Referring to FIG. 3A, a front view of the patch 214 is illustrated. In the illustrated embodiment, the patch 214 has a substantially flat and rectangular configuration, based on the configuration of the opening 212. In other embodiments, the patch 214 may have any other configuration, based on the configuration of the opening 212. More specifically, in the illustrated embodiment, a portion of the tubular component 202 around the opening 212 is substantially flattened. In such a situation, a common patch 214 may be used in different sections of the tubular component 202 that may have a flattened opening 212. In other embodiments, the opening 212 may be shaped with a curvature similar to a curvature of the tubular component 202. In such a situation, the patch 214 may have a curved configuration similar to the curvature of the opening 212 of the tubular component 202.

The patch 214 includes a first portion 302. The first portion 302 has a substantially flat configuration defining a first thickness "T1" (shown in FIG. 4). In the illustrated embodiment, the first thickness "T1" is approximately 1 millimeter (mm). In other embodiments, an actual value of the first thickness "T1" may vary based on application requirements. In an assembled position of the patch 214 on the tubular component 202, the first portion 302 extends substantially parallel with respect to the central axis X-X'. The first portion 302 also includes a number of pores 304, 306, 308. Each of the pores 304, 306, 308 is disposed adjacent and spaced apart with respect to one another. Each of the pores 304, 306, 308 defines a diameter "D". In the illustrated embodiment, the diameter "D" measures approximately 1 mm. In other embodiments, an actual value of the diameter "D" of each of the pores 304, 306, 308 may vary based on application requirements.

Figure 4B:
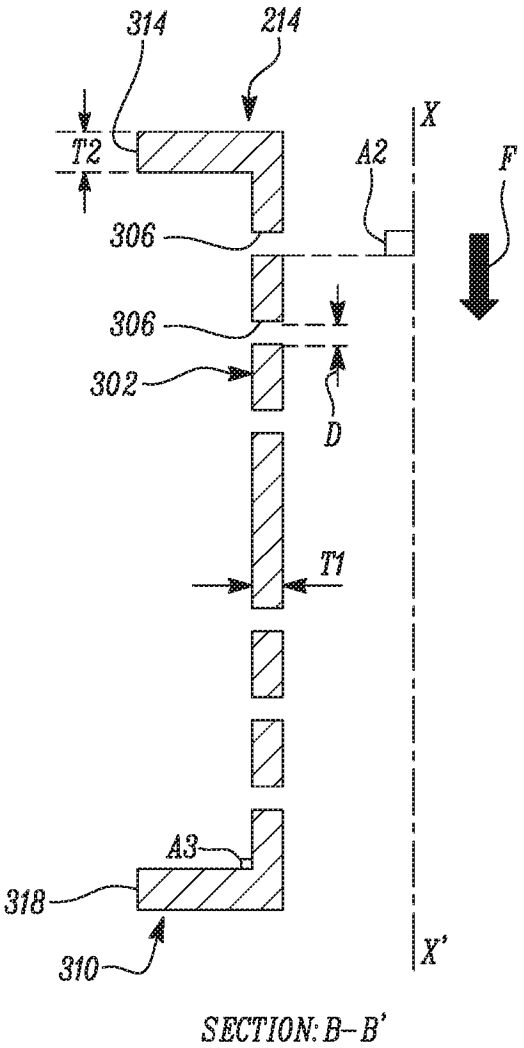
FIG. 4B is a cross sectional view of the patch of FIG. 3A along a section B-B', according to an aspect of the present disclosure.
Figure 4A:
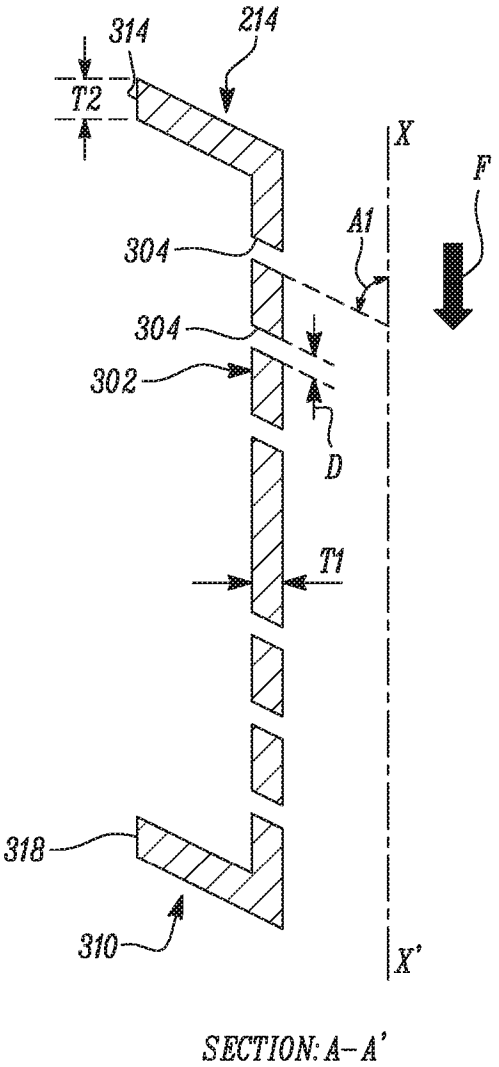
FIG. 4A is a cross sectional view of the patch of FIG. 3A along a section A-A', according to an aspect of the present disclosure.
Figure 4D:
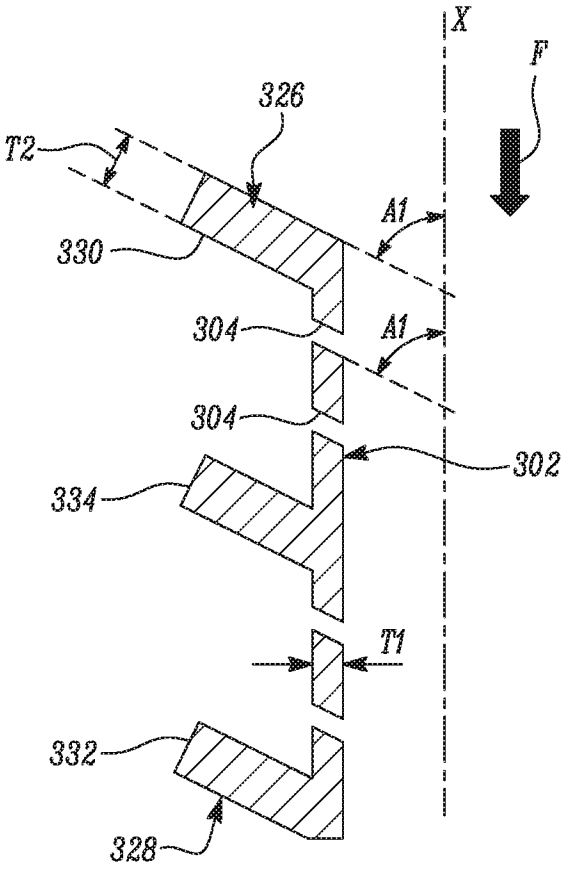
FIG. 4D is a cross sectional view of another exemplary patch, according to an aspect of the present disclosure.

Referring to FIG. 4A, a cross sectional view of the patch 214 along a section A-A' (shown in FIG. 3A) is illustrated. The section A-A' passes through a row of the pores 304 and a row of the pores 306. In the illustrated embodiment, each of the pores 304 and the pores 306 is inclined at an angle "A1" with respect to the central axis X-X' and opposing a flow direction "F" of the exhaust gas through the tubular component 202. The angle "A1" is adapted to limit exfiltration of the exhaust gas from the tubular component 202 through each of the pores 304 and the pores 306. In the illustrated embodiment, the angle "A1" measures approximately 45 degrees) (°). In other embodiments, an actual value of the angle "A1" may vary based on application requirements.

Referring to FIG. 4B, a cross sectional view of the patch 214 along a section B-B' (shown in FIG. 3A) is illustrated. The section A-A' passes through another row of the pores 304 the pores 306. In the illustrated embodiment, each of the pores 304 and the pores 306 is disposed substantially perpendicular with respect to the central axis X-X' and the flow direction "F" of the exhaust gas through the tubular component 202. Accordingly, an angle "A2" defined with respect to the central axis X-X' and the flow direction "F" measures approximately 90°. It should be noted that an arrangement of each of the pores 304, 306 described herein is merely exemplary and may vary based on application requirements.

For example, in some embodiments, the patch 214 may include only the pores 304 (as described with reference to FIG. 4A) distributed throughout a surface of the first portion 302. In such a situation, the pores 306 (as described with reference to FIG. 4B) may be omitted and replaced with the pores 304. In some embodiments, the patch 214 may include only the pores 306 (as described with reference to FIG. 4B) distributed throughout the surface of the first portion 302. In such a situation, the pores 304 (as described with reference to FIG. 4A) may be omitted and replaced with the pores 306. In yet some embodiments, the patch 214 may include a combination of each of the pores 304, 306 distributed throughout the surface of the first portion 302.

Figure 4C:
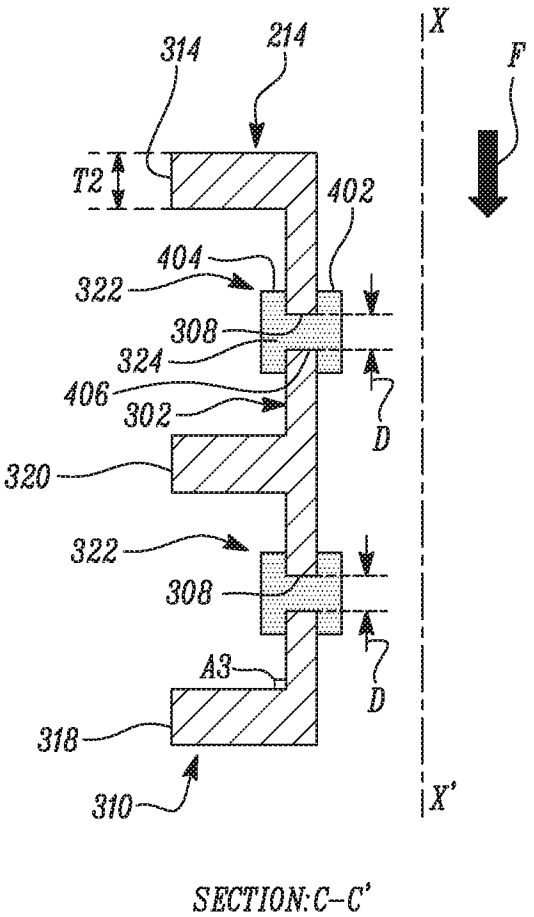
FIG. 4C is a cross sectional view of the patch of FIG. 3A along a section C-C', according to an aspect of the present disclosure.

Referring to FIG. 3A, the patch 214 also includes a second portion 310. The second portion 310 extends away from the first portion 302. Referring to FIGS. 4A to 4C, in the illustrated embodiment, the second portion 310 extends perpendicularly away from the first portion 302. Accordingly, the second portion 310 defines an angle "A3" with respect to the first portion 302, such that the angle "A3" measures approximately 90°. Also, the second portion 310 defines a second thickness "T2". In the illustrated embodiment, the second thickness "T2" is approximately 3 mm. Accordingly, the second thickness "T2" is greater than the first thickness "T1" of the first portion 302. In other embodiments, the second thickness "T2" may be approximately equal or less than the first thickness "T1", based on application requirements.

More specifically, in the illustrated embodiment, the second portion 310 includes a first rib 312, a second rib 314, a third rib 316, a fourth rib 318, and a central rib 320. Each of the first rib 312, the second rib 314, the third rib 316, the fourth rib 318, and the central rib 320 defines a frame of the patch 214. In the illustrated embodiment, each of the first rib 312, the second rib 314, the third rib 316, and the fourth rib 318 is disposed in a manner to form the rectangular configuration of the patch 214. Also, the central rib 320 is disposed between each of the first rib 312 and the third rib 316 in order to provide structural rigidity to the patch 214. In other embodiments, the second portion 310 may include any number of ribs arranged in any configuration, based on application requirements.

It should be noted that a configuration of the second portion 310 including each of the first rib 312, the second rib 314, the third rib 316, the fourth rib 318, and the central rib 320 described herein is merely exemplary and may vary based on application requirements. For example, referring to FIG. 4D, another exemplary embodiment of the patch 326 is illustrated. The patch 326 includes the first portion 302 having the pores 304 as described with reference to FIG. 4A. As such, each of the pores 304 is inclined at the angle "A1" with respect to the central axis X-X'. Further, the patch 326 includes the second portion 328, such that each of the second rib 330, the fourth rib 332, and the central rib 334 is inclined at the angle "A1" with respect to the central axis X-X'. Additionally, each of the first rib (not shown) and the third rib (not shown) may also be inclined at the angle "A1" with respect to the central axis X-X'. In other embodiments, each of the first rib, the second rib 330, the third rib, the fourth rib 332, and/or the central rib 334 may be inclined at any other angle with respect to the central axis X-X'.

The patch 214 further includes one or more wire mesh inserts 322. Each of the wire mesh inserts 322 is coupled with the first portion 302 in order to cover each of the pores 308. The pores 308 are similar in configuration to the configuration of the pores 306 as described with reference to FIG. 4B. In other embodiments, the pores 308 may be similar in configuration to the configuration of the pores 304 as described with reference to FIG. 4A. In the illustrated embodiment, the patch 214 includes two wire mesh inserts 322. In other embodiments, the patch 214 may include any number of wire mesh inserts 322 based on application requirements. In such a situation, the wire mesh inserts 322 may be disposed in any of the pores 304, 306, based on application requirements. In some embodiments, the wire mesh insert 322 may be directly disposed in one or more of holes (not shown) provided on the tubular component 202. The one or more holes may be provided extending through each of the inner surface 204 and the outer surface 206 of the tubular component 202. In such a situation, the patch 214 may be omitted.

Referring to FIG. 4C, a cross sectional view of the patch 214 along a section C-C' (shown in FIG. 3A) is illustrated. In the illustrated embodiment, the wire mesh insert 322 has a substantially H-shaped configuration. More specifically, the wire mesh insert 322 includes a first head portion 402, a second head portion 404, and an intermediate portion 406.

The intermediate portion 406 extends between each of the first head portion 402 and the second head portion 404. The intermediate portion 406 is disposed in the pore 308. Further, each of the first head portion 402 and the second head portion 404 is disposed on opposing sides of the first portion 302. More specifically, the wire mesh insert 322 may initially have a substantially T-shaped configuration (not shown). The T-shaped wire mesh insert (not shown) may then be inserted through the pore 308. The T-shaped wire mesh may then be crushed within the pore 308, such as during a riveting process, in order to form the H-shaped wire mesh insert 322 having the first head portion 402, the second head portion 404, and the intermediate portion 406. Accordingly, each of the first head portion 402 and the second head portion 404 provides an integrated retention system in order to couple the wire mesh insert 322 with the first portion 302 of the patch 214 within the pore 308.

It should be noted that the integrated retention system described herein is merely exemplary and may vary based on application requirements. For example, in other embodiments, the wire mesh insert 322 may be press fitted into one or more of the pores 304, 306, 308. In other embodiments, the wire mesh insert 322 may be snap fitted into one or more of the pores 304, 306, 308. In yet other embodiments, the wire mesh insert 322 may be integral with respect to the first portion 302 of the patch 214. Accordingly, based on a coupling method, an overall configuration of the wire mesh insert 322 may also vary.

Referring to FIG. 3A, the wire mesh insert 322 is made of a wire mesh 324. In the illustrated embodiment, the wire mesh 324 extends from each of the first head portion 402 and the second head portion 404 through the intermediate portion 406. In some embodiments, the wire mesh 324 may be directly disposed in one or more of the pores 304, 306, 308 via the intermediate portion 406 of the wire mesh insert 322. In such a situation, each of the first head portion 402 and the second head portion 404 of the wire mesh insert 322 may be omitted. The wire mesh 324 is adapted to dampen sound generated by the exhaust gas flowing through the tubular component 202. More specifically, the wire mesh 324 is adapted to dampen sound waves exiting the tubular component 202 through the pores 308. The wire mesh 324 is also adapted to limit exfiltration of the exhaust gas from the tubular component 202 through each of the pores 308.

It should be noted that a density and/or material of the wire mesh 324 may vary based on application requirements. For example, in some situations, based on a relatively higher level of required sound damping, a high density material may be employed for the wire mesh 324. As such, due to the high density material of the wire mesh 324, escaping of the exhaust gas from the tubular component 202 through each of the pores 308 may also reduce substantially. Additionally, or alternatively, a higher number of wire mesh inserts 322 may be disposed on the first portion 302 of the patch 214 in any of the pores 304, 306, 308.

In other situations, based on a relatively lower level of required sound damping, a low density material may be employed for the wire mesh 324. Additionally, or alternatively, a lower number of wire mesh inserts 322 may be disposed on the first portion 302 of the patch 214 in any of the pores 304, 306, 308. As such, based on the number of wire mesh inserts 322 and/or material of the wire mesh 324, the patch 214 may be selectively tuned for different levels of sound damping, based on application requirements. Additionally, or alternatively, a number of patches 214 may be provided on the tubular component 202 along a length and/or diameter of the tubular component 202 in order to tune the tubular component 202 for different levels of sound damping.

Figure 3B:
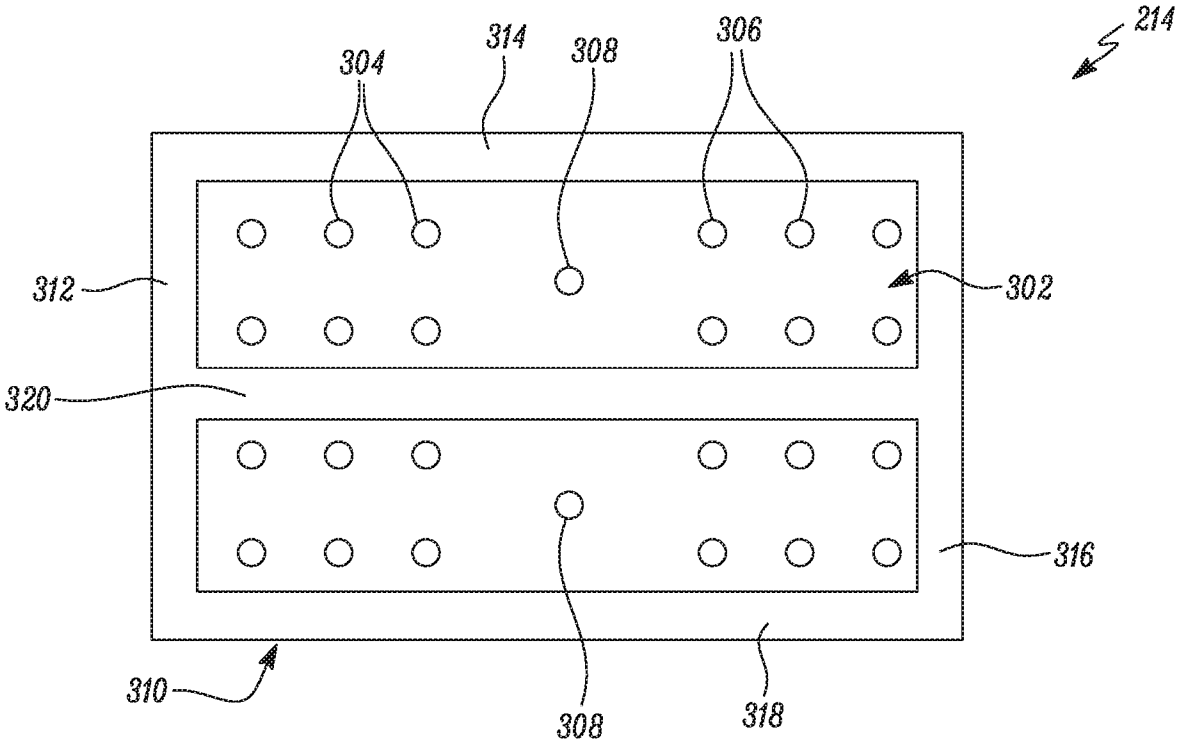
FIG. 3B is a front view of another patch for the tubular component of FIG. 2, according to another aspect of the present disclosure.
Figure 3C:
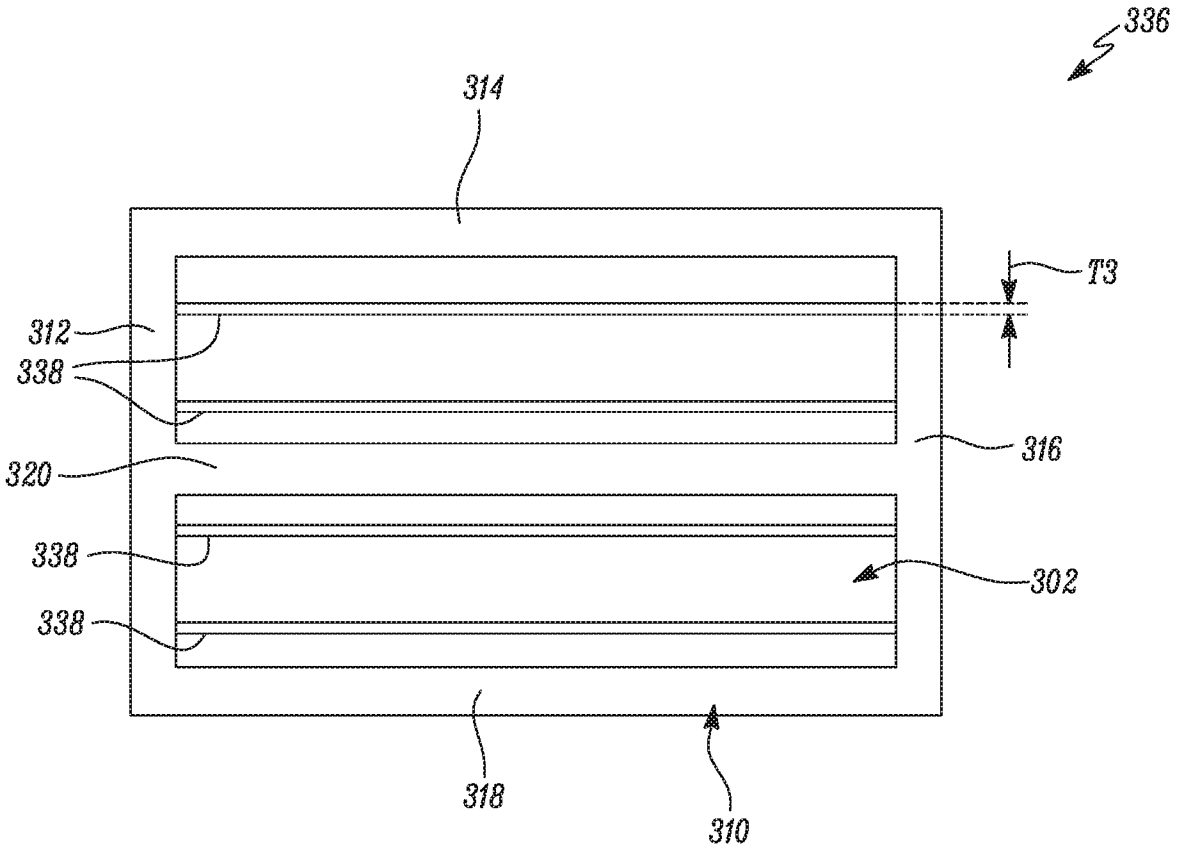
FIG. 3C is a front view of another patch for the tubular component of FIG. 2, according to another aspect of the present disclosure.

It should be noted that the wire mesh insert 322 and the wire mesh 324 described herein is merely exemplary and optional. For example, in some embodiments, referring to FIG. 3B, each of the wire mesh insert 322 and the wire mesh 324 may be omitted. In such a situation, each of the pores 304, 306, 308 may be sized in a manner to allow escaping of the sound waves while simultaneously reducing escape of the exhaust gas therethrough. In another embodiment, referring to FIG. 3C, the patch 336 may include through slots 338 provided on the first portion 302. In the illustrated embodiment, the patch 336 includes four slots 338 disposed spaced apart with respect to one another. In other embodiments, the patch 336 may include any number of slots 338 based on application requirements.

In yet other embodiments (not shown), the patch (not shown) may include a combination of the slots 338 and/or one or more of the pores 304, 306, 308 with or without the wire mesh inserts 322 and the wire mesh 324. Each of the slots 338 defines a thickness "T3". The thickness "T3" may be sized in a manner to allow escaping of the sound waves while simultaneously reducing escaping of the exhaust gas through the slots 338. In some embodiments (not shown), wire mesh inserts (not shown) with wire mesh (not shown) may be disposed in one or more of the slots 338. In such a situation, the wire mesh inserts and the wire mesh may be configured in accordance with an overall configuration of the slot 338.

Figure 5B:
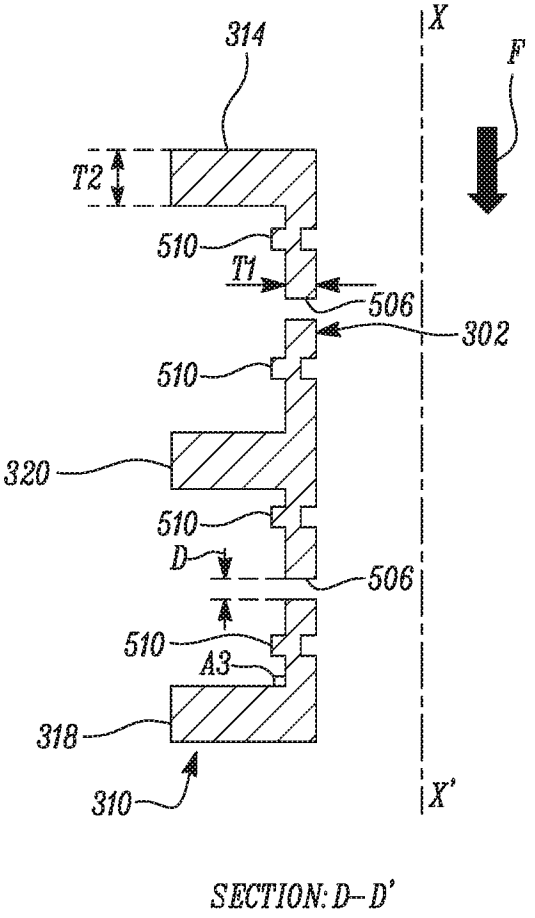
FIG. 5B is a cross sectional view of the patch of FIG. 5A along a section D-D', according to an aspect of the present disclosure.
Figure 5A:
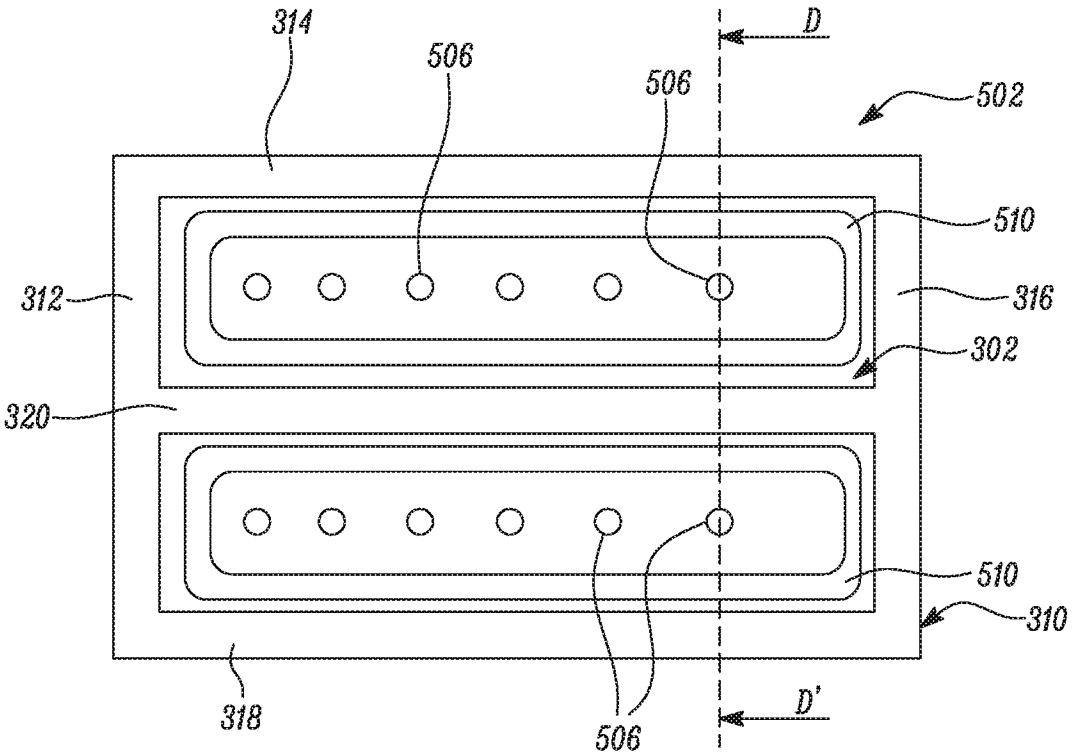
FIG. 5A is a front view of another patch for the tubular component of FIG. 2, according to another aspect of the present disclosure.

Referring to FIG. 5A, a front view of another patch 502 for the tubular component 202 is illustrated. Referring to FIG. 5B, a cross sectional view of the patch 502 along a section D-D' (shown in FIG. 5A) is illustrated. With combined reference to FIGS. 5A and 5B, the patch 502 has a configuration substantially similar to the configuration of the patch 214 described with reference to FIG. 3A. More specifically, the patch 502 includes the first portion 302, the second portion 310, and a number of pores 506. In the illustrated embodiment, each of the pores 506 has a configuration similar to the configuration of the pores 306. In other embodiments, one or more of the pores 506 may have a configuration similar to the configuration of the pores 304.

Further, the patch 502 includes a thermal expansion joint 510. In the illustrated embodiment, the thermal expansion joint 510 is provided on the first portion 302. More specifically, in the illustrated embodiment, the thermal expansion joint 510 is disposed around each of the pores 506. The thermal expansion joint 510 has a substantially raised configuration relative to the first portion 302 of the patch 502. The thermal expansion joint 510 may be made of a material similar to the material of the first portion 302, such as a metal, an alloy, and the like. The thermal expansion joint 510 provides thermal expansion of the first portion 302 during operation of the system 100, in turn, limiting thermal stress and thermal failure of the patch 502.

The patch 214, 326, 336, 502, including the first portion 302 and the second portion 310, 328, may be made of any metal, alloy, or polymer, such as aluminum, tin, steel, brass, bronze, high temperature plastic, and the like. Each of the patch 214, 326, 336, 502 and the wire mesh insert 322 may be made using any manufacturing process, such as Metal Injection Molding (MIM) process. In such a situation, the patch 214, 326, 336, 502 may be manufactured as a single piece component, such that the first portion 302 and the second portion 310, 328 may together form an integral structure. Also, the wire mesh insert 322 may be manufactured as a single piece component, such that the first head portion 402, the second head portion 404, and the intermediate portion 406 may together form an integral structure.

The patch 214, 326, 336, 502 provides a simple and effective method for damping sound generated by the exhaust gas flowing through the tubular component 202. More specifically, the patch 214 includes the wire mesh inserts 322 provided in one or more of the pores 304, 306, 308. The wire mesh 324 of the wire mesh inserts 322 provides damping of sound as the sound may exit through one or more of the pores 304, 306, 308. Additionally, the wire mesh 324 limits leakage of the exhaust gas from the tubular component 202 through one or more of the pores 304, 306, 308.

The patch 214, 326, 336, 502 and/or the wire mesh insert 322 is manufactured using the MIM process. As such, one or more of the pores 304, 306, 308, 506 having the diameter "D" less than or approximately equal to 1 mm can be formed with reduced complexity on the first portion 302 having the first thickness "T1" approximately equal to or higher than 1 mm. Further, the second portion 310, 328 provides increased structural rigidity to the patch 214, 326, 336, 502. Also, the MIM process provides integral manufacturing of the first portion 302 and the second portion 310, 328, in turn, improving product durability. Additionally, the MIM process provides manufacturing the patch 214, 326, 336, 502 in three-dimensional (3D) configuration, such as with the curvature similar to the curvature of the tubular component 202.

The MIM process also provides ease of manufacturing relatively small diameter pores on a relatively higher thickness surface. The wire mesh insert 322 provides reduced accumulation of debris, such as salts, mud, dust, and the like, around one or more of the pores 304, 306, 308, in turn, reducing premature failure of the system 100. The patch 214, 326, 336, 502 with or without the wire mesh inserts 322 may be easily incorporated into existing systems with little or no modification to the existing system, in turn, providing improved product compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof

What is claimed is:

1. A vehicle exhaust system comprising:

a tubular component having an inner surface and an outer surface, wherein the inner surface defines a primary exhaust gas flow path, wherein the tubular component defines a central axis extending between an inlet end and an outlet end of the tubular component;

at least one opening defined by the tubular component, the at least one opening providing a secondary exhaust gas flow path, wherein the at least one opening extends through each of the inner surface and the outer surface; and a patch adapted to cover the at least one opening, the patch including:

a first portion extending parallel to the central axis, the first portion comprising a plurality of spaced pores, wherein the first portion covers the at least one opening; and wherein each of the plurality of pores has a diameter and wherein a distance between adjacent spaced pores exceeds the diameter of any of the plurality of pores; and a second portion comprising a plurality of ribs defining a frame circumscribing the first portion and extending away from the first portion, the frame comprising a center rib dividing the first portion into first and second lands separated by the center rib;

wherein the first portion has a first thickness and the second portion has a second thickness for providing structural rigidity to the first portion.

2. The vehicle exhaust system of claim 1, wherein the second portion extends perpendicularly away from the first portion.

3. The vehicle exhaust system of claim 1 further includes at least one wire mesh insert coupled with the first portion, the at least one wire mesh insert adapted to cover at least one of the plurality of pores.

4. The vehicle exhaust system of claim 1, wherein the second thickness is greater than the first thickness.

5. The vehicle exhaust system of claim 1, wherein the first portion further includes a thermal expansion joint.

6. The vehicle exhaust system of claim 1, wherein at least one of the plurality of pores is inclined with respect to the central axis.

7. The vehicle exhaust system of claim 6, wherein the second portion is inclined with respect to the central axis.

8. The vehicle exhaust system of claim 3, wherein the at least one wire mesh insert further includes an integrated retention system for coupling with the first portion of the patch.

9. The vehicle exhaust system of claim 1, wherein the first portion and the second portion together form an integral structure.

10. The vehicle exhaust system of claim 1, wherein the tubular component is a muffler.

11. The vehicle exhaust system of claim 1, wherein the plurality of pores are angled with respect to a central axis of the tubular component.

12. The vehicle exhaust system of claim 11, wherein the angle of the plurality of pores is opposite a flow direction through the tubular component.

13. The vehicle exhaust system of claim 11, wherein the angle of the plurality of pores is approximately 45 degrees.

14. The vehicle exhaust system of claim 1, wherein the first land and the second land are equal size.

15. The vehicle exhaust system of claim 1, wherein the plurality of spaced pores includes spaced pores on both the first land and the second land.

16. The vehicle exhaust system of claim 1, wherein the center rib extends parallel to the central axis.

17. The vehicle exhaust system of claim 1, wherein the patch is substantially flat.

18. A tubular component for a vehicle exhaust system, the tubular component comprising:

an inner surface and an outer surface, wherein the inner surface defines a primary exhaust gas flow path, wherein the tubular component defines a central axis extending between an inlet end and an outlet end of the tubular component;

at least one opening providing a secondary exhaust gas flow path, wherein the at least one opening extends through each of the inner surface and the outer surface; and a patch adapted to cover the at least one opening, the patch including:

a first portion extending parallel to the central axis, the first portion defining a plurality of pores, wherein the first portion covers the at least one opening; wherein the first portion comprises lands surrounding each of the plurality of pores and wherein an area of the lands surrounding each of the plurality of pores is greater than an area of each of the plurality of pores;

a second portion comprising a plurality of ribs defining a frame circumscribing the first portion and extending away from the first portion, the frame comprising a center rib dividing the first portion into first and second lands separated by the center rib; wherein the first portion and the second portion together form an integral structure, wherein the first portion has a first thickness and the second portion has a second thickness; and at least one wire mesh insert coupled with the first portion to cover at least one of the plurality of pores, wherein the at least one wire mesh insert includes an integrated retention system for coupling with the first portion of the patch.

19. The tubular component of claim 18, wherein the second portion extends perpendicularly away from the first portion.

20. The tubular component of claim 18, wherein the second thickness is greater than the first thickness.

21. The tubular component of claim 18, wherein the first portion further includes a thermal expansion joint.

22. The tubular component of claim 18, wherein at least one of the plurality of pores is inclined with respect to the central axis.

23. The tubular component of claim 22, wherein the second portion is inclined with respect to the central axis.

24. The tubular component of claim 18, wherein the tubular component is a muffler.

25. A patch adapted to cover at least one opening in a tubular component of a vehicle exhaust system, the patch comprising:

a first portion comprising a plurality of pores and lands surrounding each of the plurality of pores; wherein an area of the lands surrounding the plurality of pores is greater than an area of the plurality of pores;

a second portion comprising a plurality of ribs defining a frame circumscribing the first portion and extending away from the first portion, the frame comprising a center rib dividing the first portion into first and second lands separated by the center rib; wherein the first portion and the second portion together form an integral structure, wherein the first portion has a first thickness and the second portion has a second thickness; and at least one wire mesh insert coupled with the patch to cover at least one of the plurality of pores, wherein the at least one wire mesh insert includes a first head portion, a second head portion, and an intermediate portion extending between each of the first head portion and the second head portion, wherein each of the first head portion and the second head portion is adapted to couple the at least one wire mesh insert with the patch, and wherein the intermediate portion is adapted to be disposed in at least one of the plurality of pores.

26. The patch of claim 25, wherein the patch further includes a thermal expansion joint.

27. The patch of claim 25, wherein at least one of the plurality of pores is inclined with respect to a central axis.

* * * * *